United States Patent [19]

White

[11] Patent Number: 5,003,639

[45] Date of Patent: Apr. 2, 1991

[54] CAP VISOR PROTECTOR

[76] Inventor: Steven L. White, 325 W. Washington, Apt. 5, Jackson, Mich. 49201

[21] Appl. No.: 438,244

[22] Filed: Nov. 20, 1989

[51] Int. Cl.[5] ..... A42C 5/00

[52] U.S. Cl. ..... 2/187; 2/199

[58] Field of Search ..... 2/195, 199, 187, 185 R, 2/422

[56] References Cited

U.S. PATENT DOCUMENTS

| | | | |
|---|---|---|---|
| 1,106,527 | 8/1914 | Velardo | 2/187 |
| 1,337,506 | 4/1920 | Chew | 2/187 |
| 1,453,862 | 5/1923 | Check | 2/187 |
| 1,615,780 | 1/1927 | Wesala | 2/187 |
| 1,745,114 | 4/1930 | Manos | 2/187 |
| 2,137,050 | 11/1938 | Iannetta | 2/187 |
| 3,166,766 | 1/1965 | Banello, Jr. | 2/187 |
| 3,469,264 | 9/1969 | Harris | 2/187 |
| 4,345,336 | 8/1982 | Plastino | 2/187 |

*Primary Examiner*—Thomas B. Will

*Attorney, Agent, or Firm*—Beaman & Beaman

[57] ABSTRACT

The invention relates to a protector for cap visors consisting of a flexible sheet of soil resistant or washable material having ends and lateral sides which is folded over the visor periphery and the material includes fastening cords attached to clips which are releasably affixed to the edges of the visor adjacent the cap headband. The protective device covers the majority of the visor and by the use of colors, decorations or advertising the protector ascetically adds to the cap appearance.

6 Claims, 1 Drawing Sheet

CAP VISOR PROTECTOR

BACKGROUND OF THE INVENTION.

Lightweight caps are very popular for casual wear, and such caps usually include adjustable headbands, a crown and a prominent visor. Advertising or other indicia is often imprinted, embossed or otherwise applied to the front of the cap crown above the visor.

As such caps are frequently worn during work conditions when the wearer's hands are soiled the grasping of the visor to remove or adjust the cap results in the visor rapidly becoming soiled and unattractive. Previously, this problem has not been succesfully resolved.

It is an object of the invention to provide an economical cap visor protector formed of a soil resistant or washable material which may be readily applied to existing visored caps without requiring unusual skills.

An additional object of the invention is to provide a protector for visored caps which adds to the aesthetic appearance of the cap and visor as the visor protection may be formed of leather, felt or a wide variety of materials of any color.

Yet another object of the invention is to provide a cap visor protector which may be economically manufactured, is capable of having indicia or advertising located thereon, and is readily adjustable and usable with a wide variety of visor shapes, dimensions and configurations.

In the practice of the invention the cap visor protector consists of a sheet of a soil resistant material, such as vinyl or other synthetic composition having a smooth surface from which soil may be readily wiped and which does not attract or retain soil or the material may be of a washable fabric easily cleaned by washing.

The protector material includes ends and lateral sides which intersect the ends, and in the preferred embodiment the protector is formed of a flexible fabric having hemmed ends wherein a loop is defined at the ends extending the length thereof. Such loops and hems may be formed by sewing.

A cord extends through the hem loops and is of greater length than the associated ends as to extend therefrom, and preferably, the cord is in the form of a continuous loop so as to extend through both end loops wherein surplus of accessible cord material extends from the lateral sides of the sheet material. A clip is affixed to the accessible portions of the cord on each lateral side of the protective material of a configuration and operation permitting the clip to be readily attached to the edge of the visor t be protected.

The protective material is placed upon the front periphery of the cap visor and is folded thereover so that substantially one half of the material lies adjacent the upper surface of the visor while the other half of the protective material is disposed adjacent the visor underside. The fastening cords will be disposed both above and below the visor, and the clips will be attached to the visor lateral regions and the cords are of such length as to be under slight tension assuring close proximity of the protective material and its associated visor upper or lower surfaces.

Assembled to the cap in the above described manner the visor protector covers much of the visor without adding significant bulk thereto and protects the visor from soil marks due to handling of the visor by the wearer. The configuration of the protective material is such as to readily adapt to a wide variety of visor configurations, and no special skills are required to install the visor protector upon a cap.

BRIEF DESCRIPTION OF THE DRAWINGS

The objects and advantages of the invention will be appreciated from the following description and accompanying drawings wherein.

DESCRIPTION OF THE PREFERRED EMBODIMENT

Figure 1:
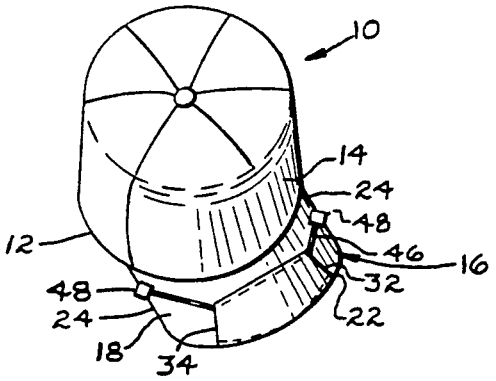
FIG. 1 is a front and side perspective view of a cap having the visor protector of the invention mounted upon the visor.

A typical cap or hat of the type with which the invention is utilized is shown in FIG. 1. The cap 10 includes a headband region 12 from which the crown 14 extends. A visor 16 extends forwardly from the headband and the visor includes an upper surface 18, an under surface 20, a front convex peripheral region 22, and lateral peripheral edges 24 substantially parallel to each other. Hats or caps of this type are of the general disclosed configuration, and it will be appreciated that the exact form of the periphery of the visor may slightly differ, i.e. the lateral edges 24 may converge rather than being substantially parallel.

The visor protector basic component is the sheet material generally indicated at 26 which is formed of a soil resistant flexible material such as vinyl or other synthetic composition or of a washable fabric which may be readily cleaned which is attractive in appearance and lightweight. It is also to be appreciated that the material 26 may be of a color which matches or contrasts the crown color, and the material 26 may be of leather, plush or other high quality material, and it is to be understood that the particular composition of the material 26 does not form a part of the instant invention.

Figure 3:
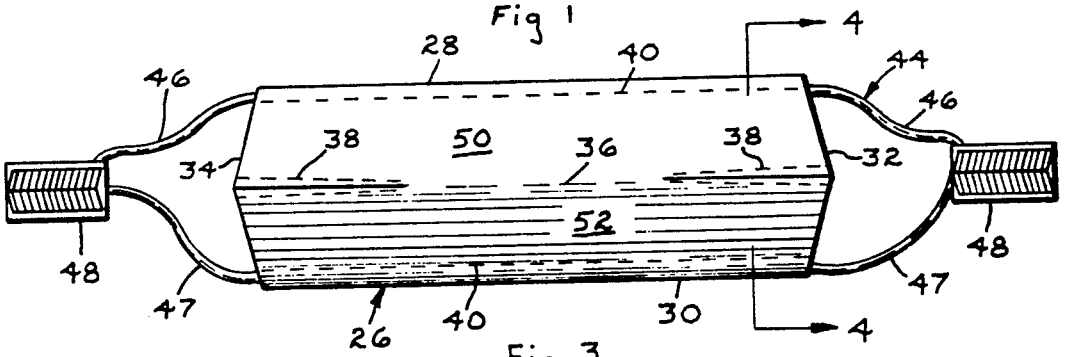
FIG. 3 is a view of the visor protector, per se, in a substantially "open" condition.

The protective material 26 may be defined by single planer sheet of flexible material, or several pieces sewn together, and the material includes ends 28 and 30 and lateral sides 32 and 34. Preferably, the lateral sides 32 and 34 are of a modified V configuration, as shown in FIG. 3, although the exact configuration of the lateral sides is a matter of choice.

Figure 4:
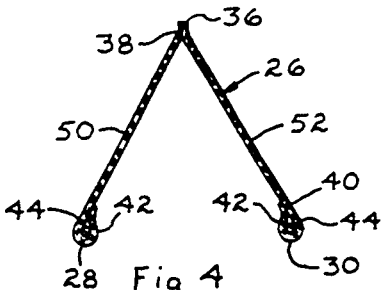
FIG. 4 is a sectional view taken along section 4—4 of FIG. 3, and, FIG. 5 is an elevational sectional view of the protective device and cap visor as taken along section 5—5 of FIG. 2.

The central region 36 of the material may be cut and sewn together in a configuration to conform to the configuration of the cap visor periphery 22, or if a slightly elastic protective material is used such forming of the central region is not necessary. As shown in FIGS. 3 and 4, in the disclosed embodiment the central region is sewn together at 38 adjacent the lateral edges 32 and 34 to configure the central region for a conforming fit to the visor peripheral portion 22.

The ends 28 and 30 of the material 26 are folded over and hemmed by sewing as at 40 forming loops 42 extending the length of the ends, and as will be appreciated, the loops 42 receive the fastening structure for the visor protector.

A flexible cord 44, is located within each of the loops 42, and preferably, the cord 44 is in the form of a single continuous loop extending through both of the hem loops 42 and is of such length as to have accessible portions 46 and 47 extending from the ends 28 and 30, respectively, upon which the fastening clips may be affixed.

The clips 48 may be of the frictional U-shaped type, or may include pivotally mounted jaws capable of opening and closing, whereby the clips may be firmly attached to the lateral edges 24 of the visor.

Figure 2:
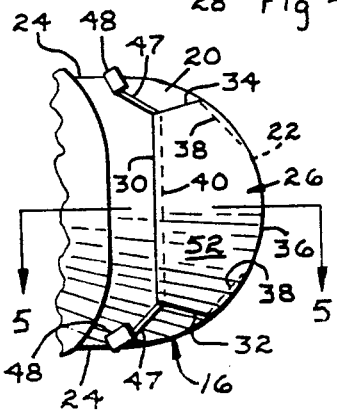
FIG. 2 is a bottom partial view of a cap visor having the visor protector mounted thereon.

In use, the protective material 26 is placed upon the cap visor 16 wherein the material portion 50 overlays the visor upperside 18, while the material portion 52 is disposed adjacent the visor underside 20. The central region 36 will be closely engaging and folded over the visor front periphery 22, FIG. 5, and the cord portions 46 will be disposed adjacent the visor upper surface 18, while the cord portions 47 will be disposed adjacent the visor under surface 20 as shown in FIG. 1 and 2, respectively. The clips 48 will be attached to the visor lateral edges 24 adjacent the headband 12, and the clips will located such that the cord 46 is under slight, but not excessive tension.

Figure 5:
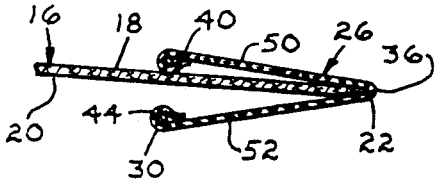

The tension within the cord 46 will pull the material central region 36 into close configuration with the visor peripheral edge 22 and maintain the material portions 50 and 52 in close relationship to the visor surfaces 18 and 20, respectively, as apparent from FIG. 5. As the visor 16 has a slight upward convex configuration the protective material portion 52 will not directly engage the visor underside 20 as apparent in FIG. 5.

As the dimensions of the protective material 26 are such that the portions 50 and 52 cover the majority of the visor surfaces 18 and 20, and as the material 26 is disposed upon the visor at those locations normally handled by the hat wearer the protective material effectively prevents direct soiling of the visor. Upon the material 26 becoming soiled release of the clips 48 permits the material to be readily removed from the hat visor and the material may be cleaned by wiping or washing, and then may be reapplied to the cap visor. It is also appreciated that the material 26 may be of an inexpensive material whereby the entire protector, or just the material 26 may be discarded when soiled.

Decorations or advertising may be readily applied to the protector material portions 50 or 52, and by forming the material of attractive colors and unusual texture the protector aesthetically adds to the appearance of the cap in addition to its utilitarian function.

It is appreciated that various modifications to the inventive concepts may be apparent to those skilled in the art without departing from the spirit and scope of the invention.

I claim:

1. A visor protector for caps having a visor including a periphery having a front region, lateral regions, and upper and lower sides comprising, in combination, a protective material having first and second portions having first and second ends, respectively, said portions being interconnected by a central region, said material portions including lateral edges intersecting the associated portion end, and attachment means extending from said portions' ends adapted to be affixed to the visor's lateral regions whereby said first and second portions are disposed over the visor upper and lower sides, respectively, and said central region engages the visor periphery front region.

2. In a visor protector as in claim 1, said material comprising a vinyl.

3. In a visor protector as in claim 1, said attachment means including flexible cords extending from said first and second ends adjacent the intersection of said ends with said portions' lateral edges.

4. In a visor protector as in claim 3, each of said material portion ends including a loop defined by said material, said cords extending through said loops.

5. In a visor protector as in claim 3, said attachment means including releasable clips mounted upon said cords for attaching said cords to the visor lateral regions.

6. A cap visor protector for overlying the front portion of a cap visor comprising, in combination, a flexible protective material having intersecting ends and lateral edges, each of said ends forming a hem, defining a loop, extending between the lateral edges, a flexible cord formed as a closed loop passing through the hems and fastening means mounted on the portions of said cord not covered by the hems for fastening said visor protector to said cap visor.

* * * * *